US005127710A

United States Patent [19]

Babichev et al.

[11] Patent Number: 5,127,710

[45] Date of Patent: Jul. 7, 1992

[54] METHOD OF BOREHOLE HYDRAULICKING OF SOLUBLE MINERALS

[76] Inventors: Nikolai I. Babichev, Bogorodsky val, 6, korpus 2, kv. 432; Grigory J. Abramov, ulitsa Udaltsova, 14, kv. 96; Viktor A. Dmitriev, Moskvorechie, 35, korpus 3, kv. 29, all of, Moscow, U.S.S.R.; Vladimir P. Paveliev, deceased, late of Moscow; by Nadezhda A. Pavelieva, administrator, ulitsa Akademika Piljugina, 20, korpus 2, Moscow; by Tatyana M. Pavelieva, administrator, pereulok Shvernika, 14, Krivoi Rog, all of U.S.S.R.

[21] Appl. No.: 644,379

[22] Filed: Jan. 23, 1991

[30] Foreign Application Priority Data

Jan. 23, 1990 [SU] U.S.S.R. ..... 4779909

[51] Int. Cl.[5] ..... E21C 37/12

[52] U.S. Cl. ..... 299/17; 175/67

[58] Field of Search ..... 299/16, 17, 3; 175/67; 166/372

[56] References Cited

U.S. PATENT DOCUMENTS 3,439,953 4/1969 Pfefferle ..... 299/17
4,319,784 3/1982 Claringbull ..... 299/17 X
4,527,836 7/1985 Uhri ..... 299/17

FOREIGN PATENT DOCUMENTS 1167332 7/1985 U.S.S.R. ..... 299/17
1328523 8/1987 U.S.S.R. ..... 299/17
1370244 1/1988 U.S.S.R. .
1372045 2/1988 U.S.S.R. ..... 299/17

OTHER PUBLICATIONS

Mining Journal, Moscow, 1986, No. 4, pp. 27–29; Pilot Installation for Hydraulicking Mineral Resources with Variable Grain Size Under the Conditions of an Unstable Overburden; V. Z. H. Arens, D. N. Shpak.

*Primary Examiner*—David J. Bagnell
*Attorney, Agent, or Firm*—Beveridge, DeGrandi & Weilacher

[57] ABSTRACT

A method of working metalliferous deposits which includes tapping a pay zone by development boreholes, hydraulically mining for a mineral in the pay zone through the formation of brine having a level which is maintained below the location of hydraulic mining of the mineral, shaping a working chamber by shifting the location of hydraulic mining along the axis of the borehole within the confines of the pay zone and lifting the brine out of the working chamber to the surface. The hydraulic mining of the mineral is alternated with the lift-of brine to the surface, such that the location of hydraulic mining is shifted from the floor of the pay zone to the roof of the pay zone at a speed which is not less than the speed at which the level of brine is rising in the working chamber. The method also includes tapping a pair of boreholes and forming working chambers in each. The hydraulic mining and accumulation of brine take place in one of the shaped working chambers while previously accumulated brine is lifted out of the other working chamber.

7 Claims, 3 Drawing Sheets

METHOD OF BOREHOLE HYDRAULICKING OF SOLUBLE MINERALS

FIELD OF APPLICATION

The invention relates to methods of working metalliferous deposits and has specific reference to a method of borehole hydraulicking of soluble minerals.

It holds out special promise in mining salts of sodium and magnesium in the form of halide and bischofite and other minerals from depths greater than 100–150 m.

The invention may also be of utility in constructing underground storages with a diameter of over 50 m for petroleum products within a relatively short period of time.

It may further find application in working mineral resources by the method of underground leaching pursuant whereto acidic solutions are circulated through pay zones, stock solutions are lifted to the surface and the useful constituent is reduced therefrom.

Underground leaching is employed mainly in extracting such metals as copper, zinc, lead, tin and gold. However, these metals quite frequently occur in the form of metalliferous clays which have a low permeability which makes their extracting difficult. Vertical crevasses in borehole walls made with the aid of the disclosed method increase the area of contact between the leaching solution and the rock so that the rate of leaching increases.

The present invention may be used in construction for making underground excavation of a given configuration as, e.g., in laying strips foundations or pile foundations.

BACKGROUND OF THE INVENTION

Underground chambers formed in the course of borehole hydraulicking of salts are widely used nowadays for the storage of petroleum and petroleum products. Therefore, an adequate shaping of chambers and the speed at which they are shaped are factors given due consideration in borehole hydraulicking.

To shape a chamber 100–150 m high and with a diameter of 50–70 m by the traditional salt-dissolving technique, a period of 2–3 years is required. Consequently, the power requirements are high and the duty factor of the pump and compressor equipment is high.

A point to be noted is that the rate of hydraulic mining is practically not influenced by the flow rate of the solvent (water in most cases), for with an increase in the flow rate the speed of advance of the water through the chamber which is being formed increases as well. But in shaping large-diameter chambers it may occur at some moment that the speedely flowing water will be short of time in order to react with the salt, and a weak brine is formed so that the rate of hydraulic mining decreases.

Known in the art is a method of borehole hydraulicking of soluble minerals (SU; A; 1,370,244) pursuant whereto a pay zone is tapped by boreholes, their walls are supported by a casing extending all the way down the overburden. A hydraulicking apparatus is placed in the borehole to mine hydraulically the mineral, dissolving it into a brine. At the same time, compressed air is admitted into the borehole through the annulus between the casing and the apparatus which causes the hydrodynamic level of brine in the borehole to sink below the zone of hydraulic mining of the mineral. The differential pressure of the compressed air causes the brine to lift to the surface over a pipe provided inside the apparatus. Working chambers are shaped by displacing the apparatus along the axis of the borehole simultaneously with revolving about the vertical axis.

Owing to the sinking of the hydrodynamic level of brine below the zone of hydraulic mining, the face stays "dry". A low density of the efflux medium preserves high hydrodynamic characteristics of the water jets. In a flooded hole this is not the case.

But the high pressure of the air has a deteriorating effect on the water jets issuing from the monitors. They become less compact, their axial pressure decreases and so does their range with the result that the rate of hydraulic mining of the mineral decreases.

This disadvantage is eliminated in a known method of borehole hydraulicking of soluble minerals (V. Zh. Arens, D. N. Shpak-Pilot Installation for Hydraulicking Mineral Resources With Variable Grain Size Under the Conditions of an Unstable Overburden, Mining Journal, Moscow, 1986, No. 4, pp 27–29). The method is operated as follows.

A pay zone is tapped with development boreholes the walls whereof are supported by a casing string extending down through the overburden. A hydraulicking apparatus is placed in a borehole and hydraulic mining of the mineral is started. The brine so formed is lifted to the surface by an air lift, whereby the hydrodynamic level of brine in the chamber so formed is kept below the zone of hydraulic mining of the mineral.

In working, the zone of hydraulic mining is shifted along the axis of the borehole within the confines of the pay zone so as to shape working chambers used for storing liquid and gaseous products eventually.

Unlike the above method, this one uses air at the atmospheric pressure in the borehole, for the working chamber connects to the atmosphere through the annulus between the apparatus and the casing.

Nevertheless, this method is also not free from some disadvantages the main whereof are discussed hereinafter.

The air lift located mainly next to the hole bottom requires an additional air pipe to be included into the hydraulicking apparatus. This increases the amount of metal per structure, increases the weight of the apparatus, reduces it reliability and extends the period of round trip operations.

Apart from that, the capacity of air lift depends on the submergence: the smaller the ratio between the depth of brine in the chamber and the height of column in the pipe for lifting the brine, the lower the capacity of air lift, the lower the efficiency of hydraulicking.

In practice this disadvantage is eliminated by lowering the development borehole into the bedrock and locating the air lift below the working zone. The height of brine lift increases, but the submergence of air lift increases as well. The above ratio termed the percentage of submergence increases and so does the capacity of air lift.

However, this practice increases the scope of drilling and has therefore an adverse effect on the efficiency of the method.

Moreover, a reduced capacity of air lift reduces the rate of hydraulic mining. If the opposite is the case, the level of brine in the chamber will rise quicker than the air lift can handle it. The hydrodynamic level of brine will rise above the zone of hydraulic mining, the jets will be flooded and the rate of hydraulicking will be drastically reduced, at large radii of mining in particular.

When the air lift is located below the mining zone, the power requirements grow, for the height of brine lift increases. For lifting from great depths, the air must be fed under a high pressure attainable by using high-power compressors.

SUMMARY OF THE INVENTION AND BRIEF DESCRIPTION OF ITS ESSENCE

It is an object of the invention to reduce the scope of drilling operations.

Another object of the invention is to reduce the power requirements for hydraulic mining of minerals.

A further object of the invention is to reduce the period of time for round trip operations.

A still further object of the invention is to increase the rate of hydraulicking.

And, finally, it is also an object of the invention to reduce the weight of the hydraulicking apparatus.

These objects are realized by disclosing a method of borehole hydraulicking of soluble minerals consisting of tapping a pay zone by development boreholes, supporting the walls of boreholes within the depth of the overburden, hydraulically mining the mineral within the pay zone so as to form brine the level whereof is below the zone of hydraulic mining of the mineral, shaping a working chamber by displacing the zone of hydraulic mining along the axis of borehole within the confines of the pay zone and lifting the brine to the surface wherein according to the invention the hydraulic mining is alternated with the lifting of brine to the surface, whereby the zone of hydraulic mining is shifted from the floor of the pay zone to the roof thereof at a speed determined by the relationship $$V \geqq \frac{mQ}{kW} \; m/h$$

where

Q = rate of flow of the solvent, $m^3/h$;

W = volume of the working chamber, $m^3$;

m = thickness of the pay zone, m;

$K^1$ = coefficient allowing for irregularity of the outline of the working chamber wall.

The fact that the hydraulic mining alternates with the lift-of brine eliminates the need in the air lift. This reduces the specific amount of metal per structure by 40–45%, reduces the weight of the hydraulicking apparatus and cuts the time required for the round trip operations.

The fact that the zone of hydraulic mining is shifted from the floor of the pay zone to the roof thereof at the specified speed ensures that the rising water jets take the lead with respect to the rising hydrodynamic level of brine in the chamber. As a result, the disclosed method enables the hydraulic mining to take place under the conditions of a "dry" face. Since the pressure of air in the working chamber is at the atmospheric level, the water jets perform satisfactorily at radii of mining as large as 30–40 m.

In accordance with an embodiment of the invention, the working chamber is shaped in the course of several successive cycles of hydraulic mining and lifting brine to the surface. Accordingly, the working chamber can be formed in a configuration prescribed by the design specifications unless this is impossible to achieve in a single cycle.

It is expedient to reduce the amount of shifting of the zone of hydraulic mining with each succeeding cycle. Consequently, the roof of the working chamber will be domed and the floor thereof will be shaped as a bowl so that the roof would acquire stability and favorable conditions would be created for directing insoluble inclusions into the zone of brine accumulation, respectively.

In a preferred embodiment of the invention, when at least two boreholes are at the site of working the mineral, the hydraulic mining and the accumulation of brine take place in one borehole while in the other borehole the accumulated brine is being lifted to the surface. This pattern of operation reduces the down time of the pump-and-compressor plant and permits two working chambers to be shaped at a time without extra power requirements and time.

It is also expedient to confine the hydraulic mining within sectors extending radially with respect to the axis of the borehole during the concluding cycles of shaping the working chamber. This plan provides for creating pillars in the wall of chamber in shaping the sectors (the mean diameter of the working chamber consequently increases) which would give support to the roof and prevent the caving in thereof so as to avoid accidents (leading to abandoning the borehole) and increase the capacity of the prospective storage, reducing thus the cost of excavating a linear meter of the storage.

In another embodiment of the invention air is evacuated from the working chamber during the hydraulic mining, whereby the rate of air evacuation is not less than the rate of hydraulic mining. A rarefaction brought about in the working chamber has a positive effect on the hydrodynamic characteristics of jets and this, in its turn, is conducive to greater radii of hydraulic mining and higher outputs.

It is further expedient to feed by gravity the liquid used in hydraulic mining and control its flow rate by the flow rate of the evacuated air. This development of the invention makes a pump plant redundant and reduces the power requirements for hydraulicking mineral.

BRIEF DESCRIPTION OF THE DRAWINGS

Other objects and advantages of the present invention will become obvious from the following detailed description thereof with the reference to the accompanying drawings, wherein.

PREFERRED EMBODIMENT OF THE INVENTION

Figure 1:
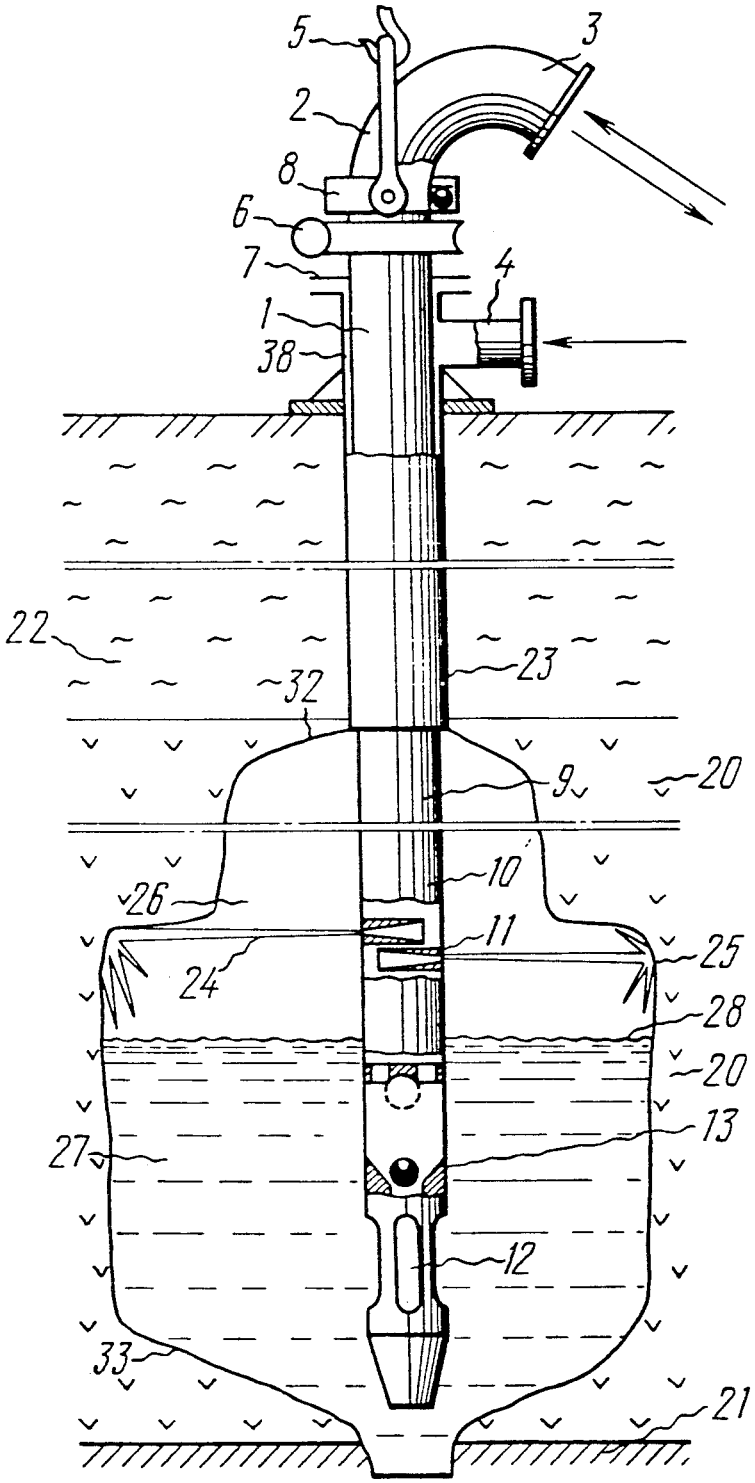
FIG. 1 is an elevation, partly cut away, of the apparatus used to operate the disclosed method.
Figure 10:
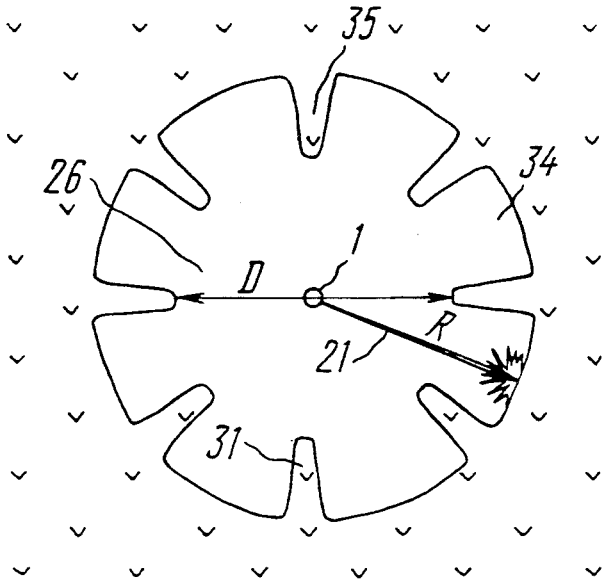
FIG. 10 is a plan view of a working chamber in cross section.

The means of realizing the disclosed method is a borehole hydraulicking apparatus 1 (FIG. 1) incorporating an upper head 2 with a branch pipe 3 for admitting force-fed water and a branch pipe 4 admitting compressed air, a mechanism 5 for lifting and lowering the apparatus 1, a mechanism 6 for imparting rotary motion to the apparatus 1 and a preventer 7.

The upper head 2 is linked by a swivel 8 to a pipe 9 for feeding water at the lower end whereof there is provided a lower head 10 with monitors 11, ports 12 for admitting brine and a ball valve 13.

Figure 2:
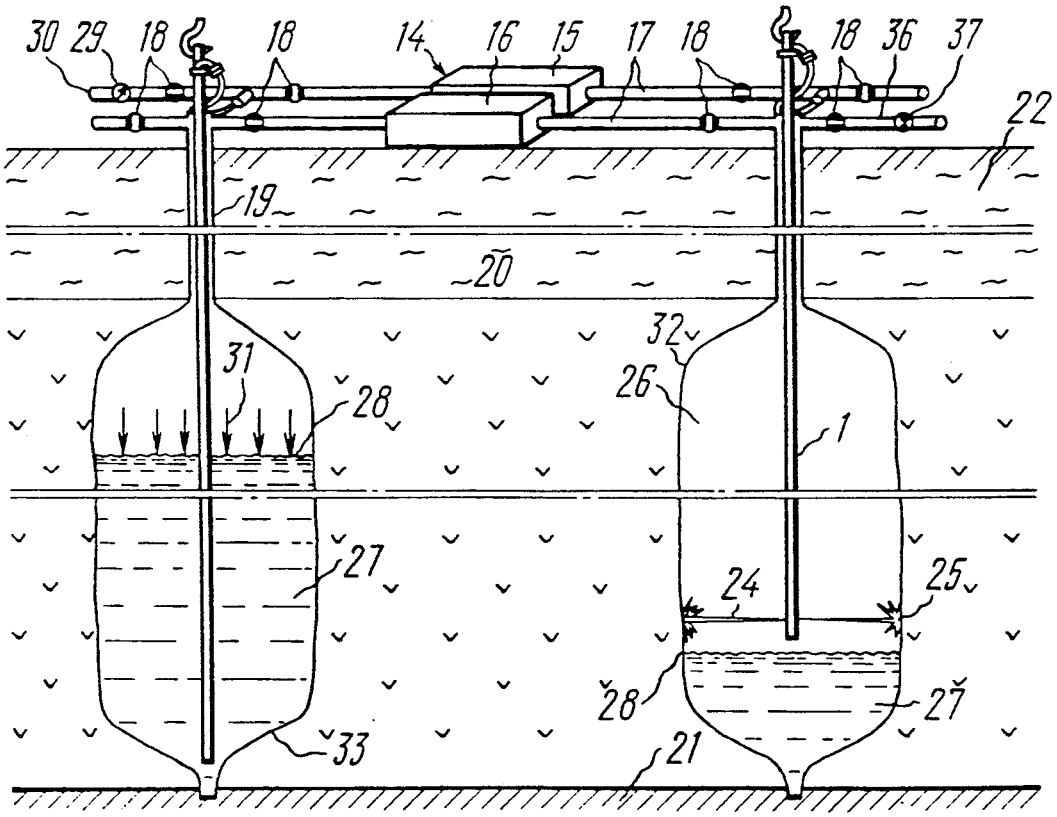
FIG. 2 is a sectional elevation of two working chambers functioning simultaneously.

To enable the apparatus to function, a pump-and-compressor plant 14 is located at the surface comprising a pump 15 (FIG. 2) and compressor 16 which are connected to the branch pipes 3, 4, respectively, over lines 17 with stop valves 18.

In operation, a pay zone 20 containing a mineral is tapped by boreholes 19 which are drilled until contact is established with a bedrock 21. Casing 23 is used to support the overburden 22.

The apparatus is connected to the pump-and-compressor plant 7 and a solvent (usually service water) is force-fed over the pipe 9, causing the ball valve 13 to lower into its seat so as to prevent leakage of the solvent through the ports 12. Thus the monitors 11 provide the only way for relieving the flow of solvent of its pressure.

Jets 24 so formed effect a hydraulic disintegration of a wall 25 and form a working chamber 26. A brine 27 which is formed accumulates in the working chamber 26 below the monitors 11.

In hydraulically mining the mineral, the apparatus is lifted and revolved about the longitudinal axis thereof at the same time so as to shape the working chamber 26 with an outline of a body of revolution. The apparatus 1 is lifted at a speed decided by the relationship $$V \geqq \frac{mQ}{kW} \; m/h \qquad (1)$$

where

Q = flow rate of the solvent, $m^3/h$;

W = volume of the working chamber, $m^3$;

m = thickness of the pay zone, m;

k = coefficient allowing for irregularity of the outline of the working chamber wall.

The speed V, whereat the hydrodynamic level 28 of the brine 27 rises in the working chamber 26 varies directly with the flow rate, Q of the solvent admitted into the borehole 19 and inversely with the cross-sectional area, S, of the working chamber 26. This corresponds to the general expression for the velocity of flow of a fluid in a pipe $$V = Q/S \; m/h \qquad (2)$$

This means that if the speed of lifting the apparatus 1 in the course of hydraulically mining mineral is decided by the relation $$V \geqq \frac{Q}{kS} \; m/h \qquad (3)$$

this will create conditions for the apparatus 1 to be lifted ahead of the rising level of the brine.

However, the above formula is inconvenient for use, since for Q = const, there is a need to know S at a given moment. Appropriate measurements are needed in this case down the borehole after each productive cycle, involving a waste of time.

By multiplying the numerator and denominator of relationship (3) by h, which is the height of the working chamber 26, we obtain the volume, W, of the chamber 26 in the denominator. Since the height, h, of the chamber 26 practically equals the thickness, m, of the pay zone 20 which is known, it is more convenient to express (3) in the form of (1). By manipulating with the known formula (2), we obtain $$V \geqq \frac{Q}{kS} \geqq \frac{Qh}{kSh} \geqq \frac{Qm}{kW} \; m/h$$

In the above formula, the coefficient k allows for irregularity of the outline of working chamber wall, varrying between 0 and 1. It acquires a maximum value when the walls of the shaped working chamber 26 are of a regular cylindrical configuration. If the walls taper by analogy with the sand glass, the coefficient k decreases. Practically, a reduction of the coefficient k is required when the jets become flooded which is the case when the speed of rising of the brine 27 in the chamber 26 exceeds the speed of lifting the apparatus 1.

The volume W, of the chamber 26 is determined after each productive cycle by measuring the volume of brine lifted to the surface. A flowmeter 29 (FIG. 2) provided on the brine outflow line can be used or the volume can be determined in any other way.

Thus, the hydrodynamic level 28 of the brine 27 always stays below the monitors 11 during the hydraulic mining. With the lifting of the apparatus 1, the shaped chamber 26 is filled with the brine 27 which expels air therefrom. On being lifted to the roof 22 of the pay zone 20 (FIGS. 4, 7), the apparatus 1 is returned to the bottom of the flooded chamber 26 (FIGS. 5, 8) and compressed air 31 is admitted over the branch pipe 4 and the casing 23 into the borehole 19 and hence into the working chamber 26. The pressure in the pipe 9 remains unchanged, equalling the density of the liquid contained therein times the height of column of this liquid while the pressure of the brine 27 in the chamber 26 increases.

The differential pressure of the brine 27 lifts the ball valve 13 which admits the brine into the pipe 9 over which it is lifted to the surface. The brine 27 enters the pipe 9 not only through the ports 12 but through the monitors 11 as well.

With the lifting of the brine to the surface, its hydrodynamic level 28 lowers, reaching finally the lower head 10. From this moment and onward the air entering the pipe 9 through the monitors 11 and rising to the surface aerates the ascending column of brine, reducing its density. In other words an air lift is set up in the lower head 10 with the result that the rate of lifting the brine 27 to the surface increases. This increase and the air bubbles in the brine 27, which are readily discernible at the surface, signify that the process of drying the working chamber 26 comes to an end.

On lifting all the brine 27 to the surface, water is again admitted into the monitors 11, and the hydraulic mining of the mineral is continued.

Figures 3, 4, 5, 6, 7, 8, 9:
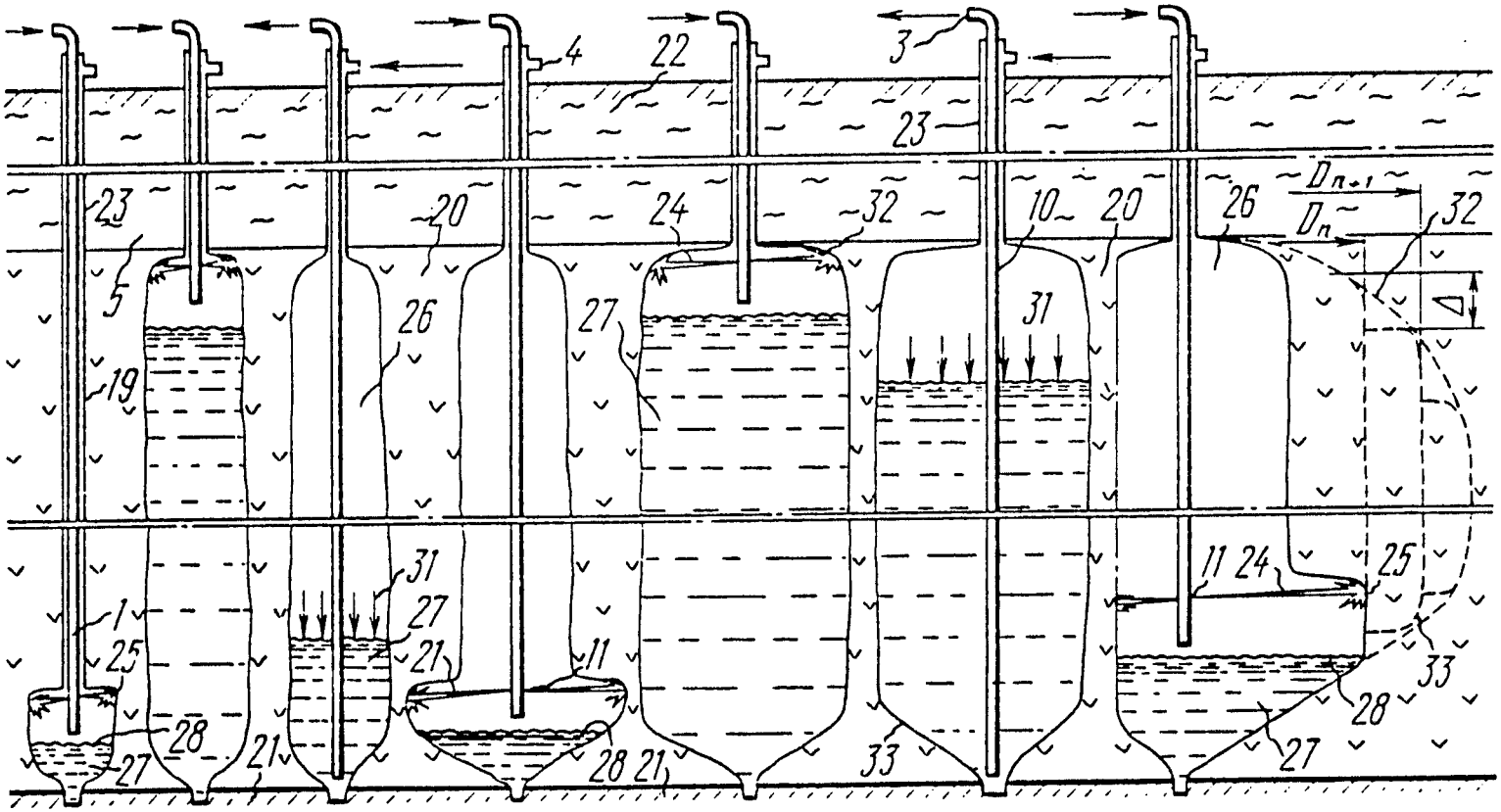
FIGS. 3 through 9 illustrated the stages of shaping a working chamber.

Thus, the hydraulic mining of the mineral (FIGS. 3, 6, 9) alternates with the lifting of the brine (FIGS. 5 and 8). The pipe 9 of the apparatus 1 is alternately used for feeding the water and lifting the brine 27.

When at least two developement boreholes 19 (FIG. 2) are available, the method is operated by alternating the feeding of water and compressed air, whereby the solvent is admitted into one borehole where the hydraulic mining of the mineral consequently goes on while compressed air is admitted into another borehole 19 and the brine is being lifted therefrom at the same time. The down time of the pump-and-compressor plant is consequently reduced. The direction of flow of the compressed air and solvent is controlled by means of the stop valves 18.

For a complet elemination of the down time of the pump-and-compressor plant, the flow rates of the air and the solvent are determined from the relationship $$\frac{Q_1}{W_1} = \frac{Q_2}{W_2} \text{ or } Q_1 W_2 = Q_2 W_1$$

where $W_1$ and $W_2$ are the volumes of the working chambers which are being dried and mined, respectively.

Obviously, if the volumes are the same, the flow rate of the solvent, $Q_2$, and that of the air, $Q_1$, must be the same as well.

In hydraulically mining the mineral, the diameter of the working chambers 26 increases with the result that the rate of mining decreases, being betrayed by a weakening of the brine concentration. Therefore, the productive cycles are repeated until the brine concentration is below a profitable level.

Further hydraulicking in the appropriate borehole 19 is beyond the economical range.

To achieve durable stability of the roof 32 of the working chambers 26, the roofs 32 are domed.

To facilitate the caving in of broken lumps of the mineral and insoluble inclusions towards the hole mouth for their further haulage throught the apparatus 1 to the surface, the bottom 33 of the chambers 26 is shaped as a bowl (FIG. 9). The technique of shaping these surface is as follows. The diameter of each working chamber 26 increases in the course of each productive cycle. Therefore, if each successive productive cycle is started with hydraulically mining at a level located above the preceding one, is, with some spacing $\Delta$, a stepped bowl is formed with an outline (taper) decided by an appropriately chosen relationship between the spacing $\Delta$ and an increment in the diameter, $D_{n+1}-D$, of the chamber. The roof 32 of each chamber 26 is shaped in the same way, i.e., by decreasing the height up to which the hydraulic mining is carried on by the distance $\Delta$. An improved stability of the roof 32 of each working chamber 26, achievable by employing the above mining tecnique, provides for extracting a greater amount of the mineral from a linear meter of each development borehole 19, for no caving in preventing an increase in the radius of hydraulic mining would be possible in this case. At the same time, the working chambers 26 formed by the hydraulicking are suitable for storing liquid and gaseous products such as pertroleum, propane, etc. A high roof stability is not only conducive to obtaining high capacities but ensures a durable and trouble-free underground storage.

When the effective radius, $R_m$, of hydraulic mining the mineral exceeds the critical diameter, $D_{cr}$, of the exposed surface area of the roof 32 of the working chamber 26 (FIG. 2), further hydraulic mining is conducted by admitting the water into the borehole 19 in a discrete manner. As a result, the mineral is being hydraulically mined only within the confines or working sectors 34. Pillars 35 left between the sectors 34 give support to the roof 32 of each working chamber 26. The pillars 35 extend radially relative to the axis of the borehole 19.

In oprating the method, air is evacuated from the working chamber 26 (FIG. 2) in the course of hydraulic mining of the mineral. To that end, a suction fan 37 is provided on an air-venting line 36 which is set into operation simultaneously with admitting water into the pipe 9. In evacuating the air, the suction fan 37 creates a rarefaction in the line 36 which spreads into the working chamber 26 through the annulus between the casing 23 and the apparatus 1. The rarefaction reduces the resistance of air so that the hydrodynamic characteristics of the jets 24 improve.

Moreover, this creates the prospect of dispensing with the pump 15 and relying on the suction fan 37 for drawing water into the borehole 19. When the hydraulic mining is performed at a depth of, e.g., 1000 m, the head of the column of water at the nozzle of the monitor 11 will be 10 MPa, less resistance to the flow, which is quite sufficient for an effective hydraulicking. The stretch of the pipe 9 at the surface is filled with the solvent before this is admitted into the boreholes 199 From this moment and onward, the solvent will flow into the borehole 19 by gravity due to the effect of continuity of the flow. To offset the pressure losses due to friction in the pipe 9 and changes in the cross-sectional area of piping and to exercise control over the hydrodynamic characteristics of the jets 24 (mainly the flow rate of solvent), the suction fan 37 has a varable capacity. This feature of the fan design alters the rarefaction of the air in the chamber 26 so that the sucking effect at the nozzle of the monitor 11 is enhanced, whereby the action of a force so set up is spread along the pipe 9. Thus, the fan 37 serves to control the performance of the apparatus 1 and that of the jets 24.

In drilling the boreholes 19, a washing liquid is commonly used for removing sludge from the hole bottoms. Therefore, on finishing with the drilling of a borehole 19 and withdrawing the drilling equipment therefrom, the borehole 19 remains filled with the washing liqiud. In this case, the method begins with drying the borehole 19. Compressed air 31 is used to that end which expels the washing liquid to the surface on being admitted into the borehole 19 through teh annulus 38 between the casing 23 and the apparatus 1 which has been lowered to the bottom of the borehole 19. On drying the borehole 19, the solvent is fed into the monitors 11 to go on with the hydraulicking as described hereinabove.

At an early stage of working a borehole, the hydrodynamic level 28 of the brine 27 rises there speedily, for the volume of the borehole 19 confined to the annulus between the wall of the borehole 19 and the apparatus 1 is small. Practically, this would mean that the uncoupling of piping unavoidable for lifting the apparatus 1 will take more time than the actual hydraulicking. At the same time, a small radius of hydraulic mining at an early stage of working a borehole 18 makes for an effective working the mineral with the jets 24 located below the level 28 of the brine 27. The duration of the productive cycle in this case depends on the performance of the jets which is characterized by the concentration of the brine 27 at the surface.

After that, the apparatus 1 is again lowered to the bottom of the shaped chamber 26 and the brine, which has accumulated there, is lifted to the surface byt admitting compressed air. The process is continued as described hereinabove.

The disclosed method offers the following advantages:

reduces scope of drilling, for the lifting of the bring with the aid of compressed air eliminates the need to drill below the line of contact between the pay zone and bedrock;

reduces power requirements stemming from reduced drilling depth and reduced height of lifting the brine;

simplification of the hydraulicking technique, for the flow rate of the solvent and that of the compressed air are independent of each other due to the separation in time of the hydraulic mining and the lifting of the brine of the surface;

reduced amount of metal per structure of the hydraulicking apparatus, reduced weight thereof, less waste of time in assembling the equipment and improved operational reliability stemming from a simplification of the design which is possible due to the seperation in time of the main operations of hydraulicking and using the apparatus for both the admittance of the solvent and the lifting of the brine through a single pipe instead of three pipes.

What is claimed is:

1. A method of borehole hydraulicking of a soluble mineral comprising:

tapping a pay zone having an overburden by forming a development borehole with internal wall;

supporting said wall for a depth of said overburden;

hydraulically mining the mineral with jets of fluid at a location within said pay zone so as to form brine;

maintaining the brine at a level below the location of hydraulic mining;

shaping a working chamber by displacing the location of hydraulic mining essentially along a central axis of said borehole within said pay zone;

lifting said brine to a location above said working chamber;

alternating said hydraulic mining with said lifting of said brine; and evacuating air directly from said working chamber during the course of hydraulic mining so as to improve hydrodynamic characteristics of the fluid jet within said working chamber.

2. A method as recited in claim 1 wherein the fluid used in the hydraulic mining is fed by gravity and wherein the method further comprises controlling the flow rate of the fluid used in hydraulic mining by varying the flow rate of air being evacuated from said working chamber.

3. A method as recited in claim 1 further comprising confining the zone of hydraulic mining through manipulation of the fluid jets to circumferentially spaced sectors extending radially relative to the central axis of the borehole such that in shaping said working chamber a plurality of circumferentially spaced supporting pillars of the mineral are formed.

4. A method of borehole hydraulicking of a soluble mineral, comprising:

tapping a pay zone having overburden by forming a pair of boreholes each having an internal wall;

supporting said walls for a depth of the overburden;

hydraulically mining the mineral at a location within said pay zone so as to accumulate brine;

maintaining the brine at a level below the location of hydraulic mining;

shaping a working chamber in each of said boreholes by displacing the location of hydraulic mining along each of said boreholes within said pay zone;

lifting said brine to a location above said pay zone;

said hydraulica mining and said lifting of brine being carried out alternatively for successive cycles and wherein the hydraulic mining and accumulation of brine takes place in one of said shaped working chambers during the lifting of previously accumulated brine in the other of said shaped working chambers.

5. A method as recited in claim 4 further comprising evacuating air directly from said working chambers during the course of hydraulic mining so as to improve hydrodynamic characteristics of said hydraulic mining.

6. A method as recited in claim 5 wherein the fluid used in the hydraulic mining is fed by gravity and wherein the method further comprises controlling the flow rate of the fluid used in hydraulic mining by varying the flow rate of air being evacuated from said working chamber.

7. A method as recited in claim 4 further comprising varying fluid flow to and from a compressor and pump positioned between said pair of boreholes and in fluid communication with each of said pair of boreholes.

* * * * *